US011715915B2

(12) United States Patent
Huber et al.

(10) Patent No.: US 11,715,915 B2
(45) Date of Patent: Aug. 1, 2023

(54) ELECTRICAL PLUG-IN CONNECTOR FOR A MULTICORE ELECTRICAL CABLE

(71) Applicant: MD ELEKTRONIK GMBH, Waldkraiburg (DE)

(72) Inventors: Martin Huber, Obing (DE); Gerd Mittermaier, Muehldorf (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 139 days.

(21) Appl. No.: 17/052,205

(22) PCT Filed: May 6, 2019

(86) PCT No.: PCT/DE2019/100408
§ 371 (c)(1),
(2) Date: Nov. 2, 2020

(87) PCT Pub. No.: WO2019/214775
PCT Pub. Date: Nov. 14, 2019

(65) Prior Publication Data

US 2021/0234317 A1 Jul. 29, 2021

(30) Foreign Application Priority Data

May 11, 2018 (DE) ..... 10 2018 207 371.6

(51) Int. Cl.
*H01R 13/66* (2006.01)
*H01R 13/05* (2006.01)
*H01R 24/28* (2011.01)

(52) U.S. Cl.
CPC ..... *H01R 13/6608* (2013.01); *H01R 13/05* (2013.01); *H01R 24/28* (2013.01)

(58) Field of Classification Search
CPC .... H01R 13/6608; H01R 13/05; H01R 24/28; H01R 2103/00; H01R 9/2425; H01R 13/66
See application file for complete search history.

(56) References Cited

U.S. PATENT DOCUMENTS 5,831,835 A 11/1998 Dirmeyer et al.
6,588,938 B1 7/2003 Lampert et al.
(Continued)

FOREIGN PATENT DOCUMENTS

CN 1349118 A 5/2002
CN 104813544 A 7/2015
(Continued)

OTHER PUBLICATIONS

Machine Translation FR 2742587 A1, (Jun. 20, 1997) (Year: 2022).*

*Primary Examiner* — Travis S Chambers
(74) *Attorney, Agent, or Firm* — Leydig, Voit & Mayer, Ltd.

(57) ABSTRACT

An electrical connector for a multi-wire electrical cable includes two cable-side electrical contact elements including associated terminals to each of which is to be connected a wire of the electrical cable, and two output-side electrical contact elements which are spaced apart from the cable-side electrical contact elements and from each of which projects an electrical connector element via which an electrical connection can be established to a mating connector. An active electrical device is disposed between the cable-side contact elements and the output-side contact elements. The active electrical device is placed on the contact elements, such that the active electrical device is in electrical contact with each of the contact elements, and such that the cable-side contact elements and the output-side contact elements are electrically connected to each other. The output-side
(Continued)

contact elements are separated and axially spaced apart from the cable-side contact elements.

16 Claims, 6 Drawing Sheets

(56) References Cited

U.S. PATENT DOCUMENTS

| | | | | |
|---|---|---|---|---|
| 6,690,184 | B1 * | 2/2004 | Akram | G01R 3/00 324/754.16 |
| 6,906,527 | B1 * | 6/2005 | Niimi | H01R 13/6683 324/633 |
| 8,388,182 | B2 * | 3/2013 | Chang | F21S 4/24 362/249.02 |
| 10,249,413 | B2 | 4/2019 | Huber et al. | |
| 2006/0089053 | A1 | 4/2006 | Morlion et al. | |
| 2011/0080158 | A1 * | 4/2011 | Lawrence | H01R 24/42 324/76.12 |
| 2015/0263445 | A1 | 9/2015 | Hoefner et al. | |
| 2016/0142030 | A1 * | 5/2016 | Hamner | H03H 7/0115 174/70 R |
| 2016/0359279 | A1 | 12/2016 | Golko et al. | |
| 2017/0076836 | A1 | 3/2017 | Huber et al. | |
| 2018/0115120 | A1 | 4/2018 | Islam | |

FOREIGN PATENT DOCUMENTS

| | | | | | |
|---|---|---|---|---|---|
| CN | 107039105 | A | | 8/2017 | |
| CN | 108092026 | A | * | 5/2018 | H01R 13/02 |
| DE | 4218793 | A1 | | 12/1993 | |
| EP | 1037328 | A1 | | 9/2000 | |
| EP | 3264426 | A1 | | 1/2018 | |
| FR | 2742587 | A1 | | 6/1997 | |
| WO | WO 9607302 | A1 | | 3/1996 | |
| WO | WO 9809486 | A1 | | 3/1998 | |
| WO | WO 2005069445 | A1 | | 7/2005 | |

* cited by examiner

ELECTRICAL PLUG-IN CONNECTOR FOR A MULTICORE ELECTRICAL CABLE

CROSS-REFERENCE TO PRIOR APPLICATION

This application is a U.S. National Phase Application under 35 U.S.C. § 371 of International Application No. PCT/DE2019/100408, filed on May 6, 2019, and claims benefit to German Patent Application No. DE 10 2018 207 371.6, filed on May 11, 2018. The International Application was published in German on Nov. 14, 2019, as WO 2019/214775 A1 under PCT Article 21(2).

FIELD

The present invention relates to an electrical connector for a multi-wire electrical cable.

Such an electrical connector includes on its input or cable side at least two electrical contact elements, for example in the form of contact plates, to each of which is connected a wire of the associated electrical cable (via a suitable terminal), and further includes on its output side at least two electrical contact elements, for example in the form of contact plates, from each of which extends an electrical connector element, for example in the form of an electrically conductive pin, to allow an electrical connection to be made therethrough to a mating connector.

This is a classical construction of an electrical connector for multi-wire electrical cables, to which connector an electrical cable is attached on the input side and which connector is provided with electrical connector elements on the output side to allow the electrical cable to be brought into electrical connection with a mating connector via the electrical connector, and especially the connector elements thereof.

BACKGROUND

With regard to the technical background of the present invention, reference may be made, for example, to WO 2005/069445 A1. In connection with the transmission of signals through electrical cables, signal conditioning is typically very important. For this purpose, suitable electrical devices are placed in the signal path. This results in increased space requirements to accommodate such devices.

SUMMARY

In an embodiment, the present invention provides an electrical connector for a multi-wire electrical cable. The electrical connector includes at least two cable-side electrical contact elements including associated terminals to each of which is to be connected a wire of the electrical cable, and at least two output-side electrical contact elements which are spaced apart from the cable-side electrical contact elements and from each of which projects an electrical connector element via which an electrical connection can be established to a mating connector. An active electrical device is disposed between the cable-side contact elements and the output-side contact elements. The active electrical device is placed on the cable-side contact elements and on the output-side contact elements, such that the active electrical device is in electrical contact with each of the cable-side contact elements and the output-side contact elements, and such that the at least two cable-side contact elements and the at least two output-side contact elements are electrically connected to each other. The output-side contact elements are separated and axially spaced apart from the cable-side contact elements.

BRIEF DESCRIPTION OF THE DRAWINGS

Embodiments of the present invention will be described in even greater detail below based on the exemplary figures. The present invention is not limited to the exemplary embodiments. All features described and/or illustrated herein can be used alone or combined in different combinations in embodiments of the present invention. The features and advantages of various embodiments of the present invention will become apparent by reading the following detailed description with reference to the attached drawings which illustrate the following.

DETAILED DESCRIPTION

Figure 1A:
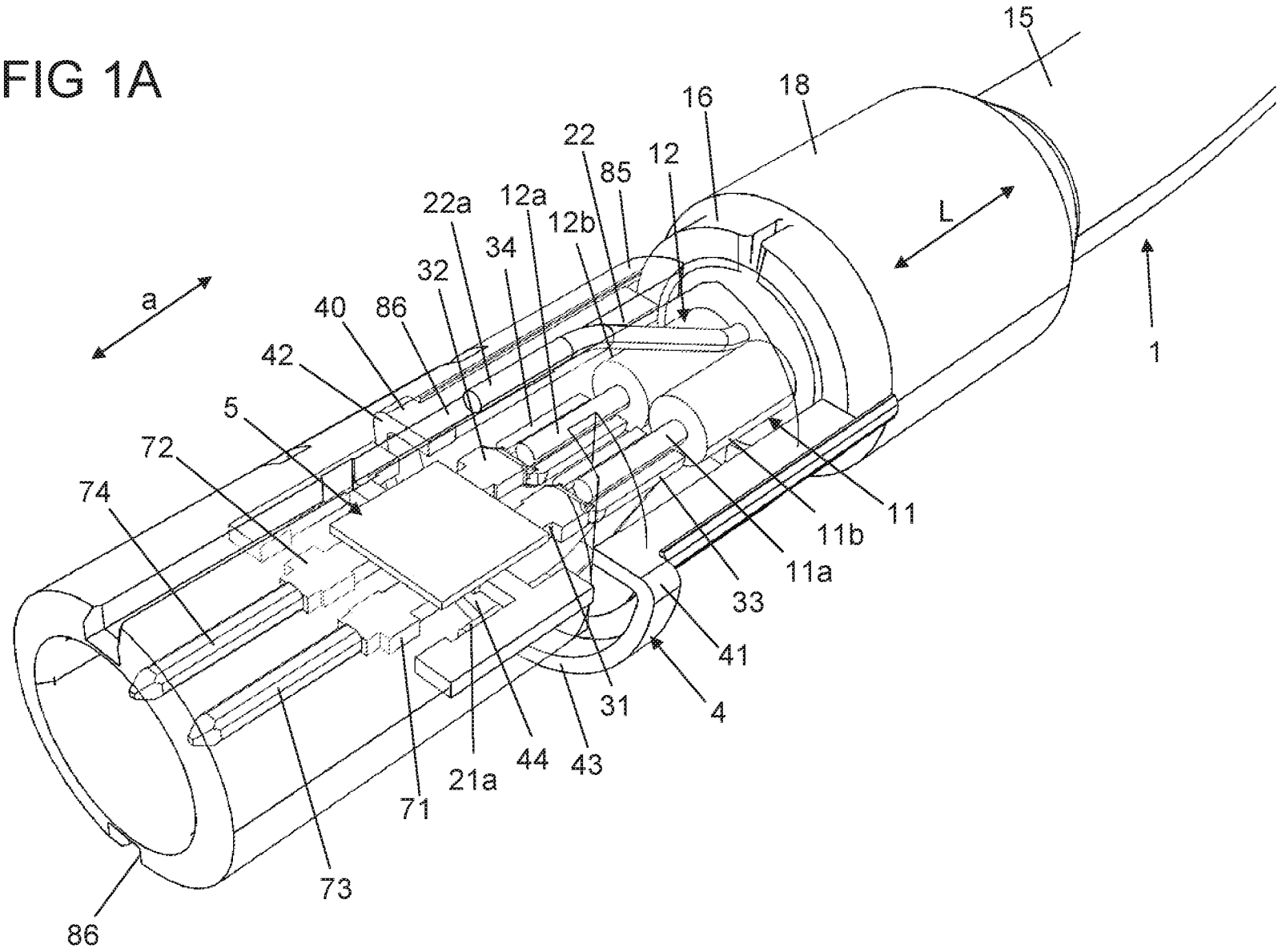
FIG. 1A shows, in partially transparent view, an electrical connector for a multi-wire electrical cable, with an active electrical device placed on contact elements of the connector, but without the associated outer conductor.

Embodiments of the present invention to improve an electrical connector of the above-mentioned type with respect to the aforedescribed requirements.

According to an embodiment of the present invention, in an electrical connector of the above-mentioned type, it is further provided that an active electrical device be disposed between the cable- or input-side electrical contact elements of the connector, on the one hand, and its output-side electrical contact elements (which are spaced apart from the cable-side electrical contact elements), on the other hand, the active electrical device being placed on the these contact elements such that it is in electrical contact with each of them. This may be accomplished, in particular, by each cable-side contact element being electrically connected to an associated output-side contact element, and by the individual (resulting) electrical connections being arranged parallel to one another; i.e., by them extending parallel to one another (and being able to form a parallel or a series connection during use). Moreover, regardless of the manner in which the electrical contacting is implemented, the electrical device is secured (mounted or fixed) in position on the electrical contact elements, for example by a material-to-material bond, in an advantageous manner (such that it lies flat thereon).

The approach of embodiments of the present invention makes it possible to dispose at least one active electrical device on the input side of a connector, between the electrical cable attached to connector and the output-side contact elements of the connector, from which project the connector elements thereof. An active electrical device is understood herein to be an electrical (in particular also an electronic) device which has an amplifying and/or processing function. For instance, the active electrical device may include an amplifier adapted to amplify data signals, in particular sensor and/or video signals. In addition, the active electrical device may include a processor adapted to process data signals, in particular sensor and/or video signals.

In accordance with an embodiment of the present invention, electrical connecting elements project from a bottom of the active electrical device (which bottom faces the contact elements), the active electrical device resting via the electrical connecting elements on the respective contact elements. The electrical connecting elements may be configured as rigid electrical connection points via which the active electrical device rests on the contact elements in a fixed position relative thereto.

For this purpose, the bottom of the active electrical device may have metallic portions from which the electrical connecting elements project and via which the electrical connecting elements are in electrical contact with the active electrical device. For example, exactly one electrical connecting element of the active electrical device may project from each metallic portion of the bottom. And the individual metal portions of the bottom may be separated and insulated from one another by insulating portions of the bottom.

The individual electrical connecting elements may each be connected by a material-to-material bond to the bottom of the active electrical device, the electrical connecting elements being configured, for example, as solder or weld balls, respectively.

Furthermore, the cable-side contact elements and the output-side contact elements may be parts of an integrally stamped conductor pattern which were separated by cutting.

In an embodiment of the present invention, a carrier may be disposed between the cable-side contact elements and the output-side contact elements, the carrier supporting the active electrical device without being in electrical contact therewith. This carrier may also have been manufactured as a part of the aforementioned integrally stamped conductor pattern.

Figure 1B:
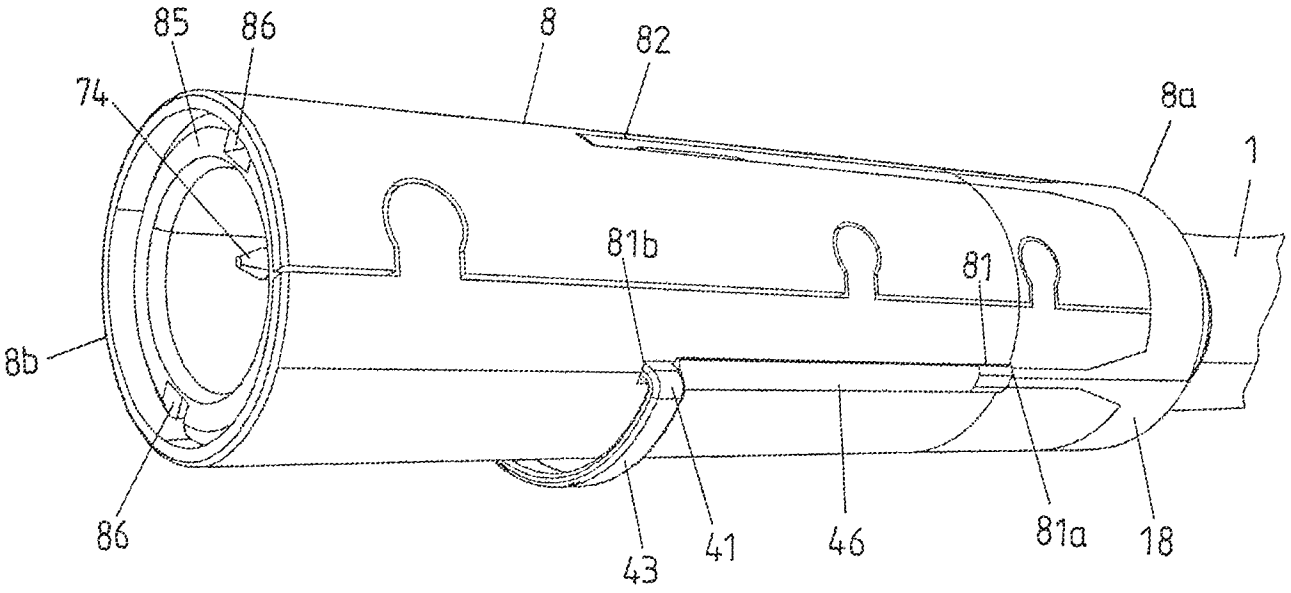
FIG. 1B shows the electrical connector of FIG. 1A together with the associated outer conductor.

FIGS. 1A and 1B show an electrical connector to which a multi-wire electrical cable 1 (shown in cross-section in FIG. 2A) is attached on the input side, and which has electrical connector elements 73, 74 on the output side for establishing an electrical connection to a mating connector. In the exemplary embodiment, electrical cable 1 takes the form of a two-wire electrical cable. The two wires 11, 12 of cable 1 extend side-by-side along longitudinal cable direction L, forming parallel wires. These are each composed of an electrical conductor 11*a*, 12*a*, for example of copper, as well as an insulating sheath 11*b*, 12*b* surrounding the respective conductor.

Wires 11, 12 of cable 1 are arranged together within a cable interior which is defined by a cable jacket 15 extending in longitudinal cable direction L and which is annularly surrounded by cable jacket 15, as viewed in cross section. Cable jacket 15 is composed of an electrically insulating material.

Moreover, a cable shield 14 (not visible in FIGS. 1A and 1B) is disposed between cable jacket 15 and the cable interior, which serves to receive wires 11, 12. Cable shield 14 may be formed, for example, by a braided shield or a film, or by a braided shield in combination with a film. Cable shield 14 is used for shielding the interior of the cable and for this purpose is made of a metallic material, such as, for example, aluminum. Thus, for example, a cable shield 14 in the form of a film may be an aluminum foil. Alternatively, it is possible to use for this purpose a plastic film that is coated with an electrically conductive material, such as aluminum, in particular on its inner surface facing the interior of the cable.

Braided shields are used, in particular, for shielding in the case of relatively low frequencies, while cable shields in the form of films are used for shielding in the case of relatively high frequencies (1 MHz to 10 GHz).

Figure 2B:
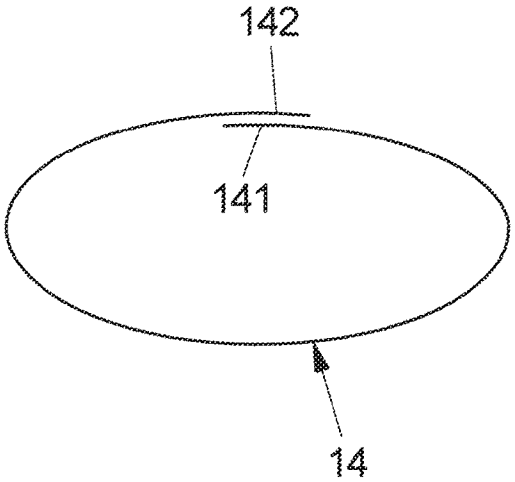
FIG. 2B shows a schematic view of a cable shield of the electrical cable.

FIG. 2B schematically shows a possible specific embodiment of a cable shield 14. Here, cable shield 14 takes the form of a film and is placed around the interior of the cable in such a way that the two connecting portions 141, 142 of the film overlap each other in the circumferential direction. When the interior of the cable has to be accessed (for example, during pre-termination of the cable), cable shield 14 can be selectively opened in the resulting overlap region.

Cable shield 14 and cable jacket 15 may be combined into one unit, for example by bonding the outer surface of cable shield 14, which faces away from the interior of the cable, to cable jacket 15, for example by an adhesive.

In the present case, in addition to wires 11, 12, stranded drain wires 21, 21 are disposed in the cable interior, each extending, together with wires 11, 12, along longitudinal cable direction L. Stranded drain wires 21, 22 are electrically conductive and not insulated and are in electrical contact with cable shield 14. Such stranded drain wires 21, 22 are used to bring cable shield 14 to ground potential in a defined manner, and advantageously to do so even when cable shield 14 is locally damaged, such as when a cable shield 14 in the form of a film is torn in some sections. Moreover, stranded drain wires 21, 22 may, in addition, contribute to the shielding of the cable interior.

Figure 2A:
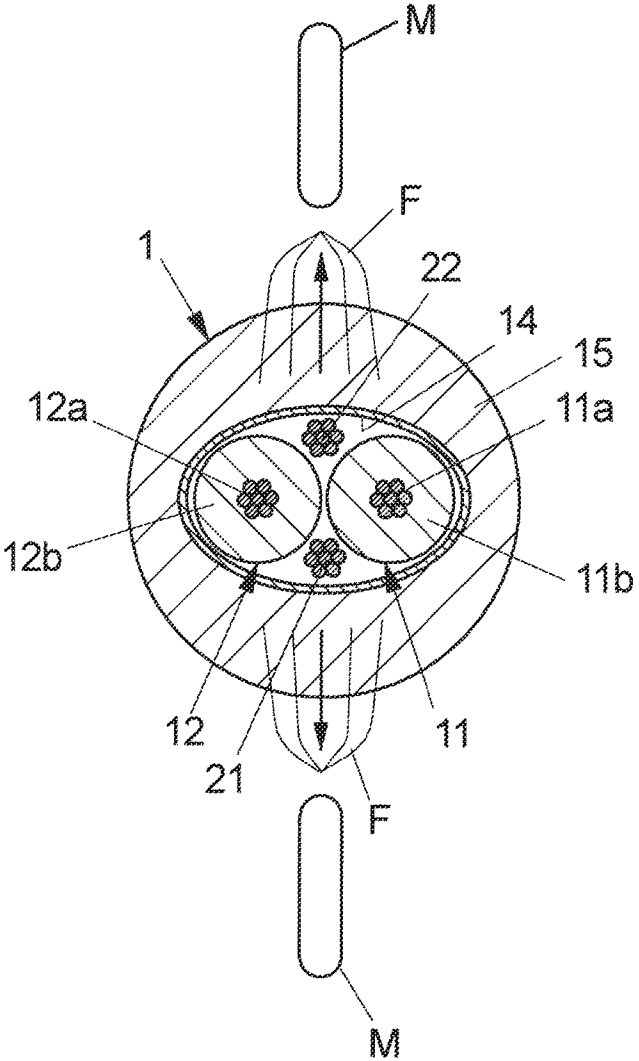
FIG. 2A shows a cross section through the electrical cable attached to the connector of FIG. 1A.

For purposes of pre-terminating the cable of FIG. 2A to provide the cable with an electrical connector 1, as shown in FIGS. 1A and 1B, stranded drain wires 21, 22 must be separated from wires 11, 12 to enable a respective cable component to be moved to the connector region intended for this purpose. To facilitate such assembly work, a respective stranded drain wire 21, 22 may include a magnetic, in particular ferromagnetic material. This material may be an alloy (based on iron, nickel, cobalt), in particular steel.

In a variant, a respective stranded drain wire 21, 22 is completely made of an electrically conductive ferromagnetic material. In another variant, a respective stranded drain wire 21, 22 includes at least one core made of a ferromagnetic material and surrounded by an electrically conductive material. This embodiment makes it possible, on the one hand, to optimize the core of a respective stranded drain wire 21, 22 with respect to the magnetic properties and to optimize the conductive outer portion of a respective stranded drain wire 21, 22 with respect to the electrical properties (also with respect to the skin effect at high frequencies). Thus, a respective stranded drain wire 21, 22 may be composed, for example, of a core of steel coated with copper. The coating may be applied, for example, by electrodeposition.

Both a respective wire 11, 12 and a respective stranded drain wire 21, 22 of electrical cable 1 of FIGS. 1A, 1B and 2A are normally composed of a plurality of strands.

For purposes of pre-terminating electrical cable 1 of FIG. 2A, for example, to attach it to an electrical connector as shown in FIGS. 1A and 1B, cable jacket 15 is removed from a connecting portion of cable 1 (at the connector end thereof). In the exemplary embodiment, magnetic forces are used to separate stranded drain wires 21, 22 from wires 11, 12 of the cable, for example to enable those cable components 11, 12; 21, 22 to be moved separately to the corresponding terminals of the connector of FIG. 1A. For this purpose, as can be seen from FIG. 2A, a magnet M is approached to a respective stranded drain wire 21, 22 at the connector-side cable end after cable jacket 15 has been cut open at the respective cable end. Magnet M produces a magnetic field F which, because of the ferromagnetic material included in the stranded drain wire, tends to move the respective stranded drain wire 21, 22 out of the interior of the cable, as is apparent from the configured state of cable 1 shown in FIG. 1A. In this way, stranded drain wires 21, 22 can be easily separated from wires 11, 12 of the cable without having to manipulate wires 11, 12 and/or stranded drain wires 21, 22 with tools.

What is essential to the method described herein is that a respective stranded drain wire 21, 22 include a material having such magnetic properties that stranded drain wire 21, 22 can be separated from wires 11, 12 of cable 1 under the action of magnetic forces. This means that the magnetic properties of stranded drain wire 21, 22 must differ from those of a respective wire 11, 12.

By lifting a respective stranded drain wire 21, 22 out of the interior of the cable under the action of magnetic forces, it is possible to automatically open a cable shield 14 formed by a film of the type shown in FIG. 2B. This merely requires that the ends 141, 142 of cable shield 14 move away from one another under the action of the outwardly moving stranded drain wires 21, 22.

The connector-side end of cable 1 has a support crimp 16 placed thereon, which may (optionally) be surrounded by a potting body 18, for example in the form of a ferrite core filter overmold. Such a (ferrite core) filter on the cable side functions here as a sheath current filter, especially to suppress sheath currents in the form of high-frequency common-mode interferences, which are caused, for example, by electrical devices and propagate along cable 1. Thus, this filter serves to eliminate or reduce common-mode interferences which occur in co-phasal relationship in the two parallel wires 11, 12 or electrical conductors 11*a*, 12*a* and which, in the present example, are caused in particular by sheath currents.

The connector adjacent to the connector-side end of cable 1 includes an outer conductor 8, which in the exemplary embodiment takes the form of an outer tube, and which is composed of an electrically conductive material and surrounds the connector annularly, or in the exemplary embodiment specifically circularly, as viewed in cross section. Outer conductor 8 extends along a longitudinal direction (longitudinal cable direction L); i.e., axially from a first, cable-side end 8*a* to a second, output-side end 8*b*, and may be connected to support crimp 16, for example by a material-to-material bond (by welding).

Outer conductor 8 has a pair of first slots 81 and a pair of second slots 82. In the present case, the slots 81 or 82 of a respective pair of slots are disposed opposite each other on outer conductor 8. Moreover, in the exemplary embodiment, the slots 81 of the first pair of slots are offset from the respective slots 82 of the second pair of slots by 90° in the circumferential direction of outer conductor 8.

Slots 81 and 82 each extend in the axial direction of the connector (and thus also along longitudinal cable direction L) to the cable-side axial end of outer conductor 8 (where they form an open end of the respective slot).

The connector components disposed in the interior space of the connector, which is enclosed by outer conductor 8, include, on the input side (i.e., on the cable side), first, cable-side electrical contact elements 31, 32, here in the form of contact plates. Each of these has integrally formed therewith a terminal in the form of a receptacle 33, 34 for a respective (stripped) electrical conductor 11*a* or 12*a* of wires 11, 12 of electrical cable 1. By fixing the electrical conductor 11*a*, 12*a* (conductive core) of a respective wire 11, 12 of cable 1 in the respectively associated receptacle 33, 34, electrical contact is provided through the respective (electrically conductive) receptacle 33, 34 to a respectively associated cable-side electrical contact element 31, 32.

On the output side (and spaced apart in axial direction a from cable-side contact elements 31, 32), the connector has second, output-side contact elements 71, 72 (in the interior space enclosed by outer conductor 8), each of which has integrally formed therewith a connector element 73 or 74, which here takes the form of a connector pin and via which the connector is electrically connectable to a mating connector. In the exemplary embodiment, connector elements 73, 74 project from the respectively associated output-side contact elements 71, 72 in axial direction a.

An active electrical device 5, for example in the form of an electrical device including a processor and/or an amplifier, is disposed between cable-side contact elements 31, 32 and output-side contact elements 71, 72. The term "electrical device," as used herein, explicitly includes electronic devices and, in particular, semiconductive devices. In particular, the electrical device may be a device for amplifying signals such as data, sensor and/or video signals, (e.g., a gain driver), and/or a device for processing signals such as data, sensor and/or video signals (e.g., a micro-controller).

Furthermore, in the exemplary embodiment, a carrier body 4 is (optionally) disposed between cable-side contact elements 31, 32 and output-side contact elements 71, 72 (in spaced contact-free relationship thereto). Carrier body 4 may serve for supporting and positioning active electrical device 5 within the connector. However, it does not serve to electrically connect electrical device 5; i.e., there is no electrical contact between active electrical device 5 and carrier body 4. Moreover, carrier body 4 does not have any conductive traces or other elements via which electrical signals could be fed to or picked up from active electrical device 5. Nevertheless, carrier body 4 may be composed of an electrically conductive material, especially if active electrical device 5 is (partially) accommodated in an insulating housing. Active electrical device 5 may be joined via its housing to carrier body 4 by a material-to-material bond, for example by soldering, brazing, welding or adhesive bonding.

Active electrical device 5 is electrically connected via (rigid) electrical connecting elements 51, 52 to cable-side contact elements 31, 32, on the one hand, and to output-side contact elements 71, 72, on the other hand. This means that wires 11, 12 of electrical cable 1 are electrically connected via active electrical device 5 to the respective connector elements 73, 74 of the connector. Thus, electrical signals which are fed to the connector via wires 11, 12 of cable 1 pass through active electrical device 5 before they are output via connector elements 73, 74 to a mating connector and thus to an electrical unit associated with the mating connector.

In particular, the cable-side (input-side) contact elements 31, 32, on the one hand, and the output-side contact elements 71, 72, on the other hand, may be electrically connected to each other pairwise via active electrical device 5. That is, each of cable-side contact elements 31, 32 is connected via active electrical device 5 to a respective one of output-side contact elements 71, 72, as will be explained hereinafter in more detail with reference to FIGS. 3A, 4A and 4B.

Active electrical device 5 is here disposed substantially centrally within electrical cable 1, in particular with respect to the central axis of electrical cable 1. Furthermore, active electrical device 5 is located (approximately) on a plane defined by the cable-side and output-side contact elements 31, 32; 71, 72. It is disposed in the axial direction (longitudinal cable direction L) between cable-side contact elements 31, 32, on the one hand, and output-side contact elements 71, 72, on the other hand, and in particular approximately centrally.

Carrier body 4 may take the form of, for example, a stirrup-shaped carrier bracket. For purposes of holding active electrical device 5, carrier body 4 has two (flat, spaced-apart) support regions 41*a*, 42*a* of a support assembly 40, which are each integrally formed with a respective one of a first connecting section 41 and a second connecting section 42 of carrier body 4. (In the exemplary embodiment, support regions 41*a*, 42*a* are spaced apart in a direction transverse to axial direction of the connector). Active electrical device 5 is placed on support regions 41*a*, 42*a* of carrier body 4 for added support (compare FIGS. 3A and 3B). Alternatively, supporting the active electrical device 5 by means of carrier body 4 may also be dispensed with because, via connecting elements 51, 52, active electrical device 5 rests on, and is electrically connected to, contact elements 31, 32; 71, 72 and, at the same time, may be secured (spatially fixed) thereon.

A supporting section 43, respectively 44, of carrier body 4 extends from a respective one of the connecting sections 41, 42 at support regions 41*a*, 42*a* of carrier body 4. The respective supporting section extends in a curved (arcuate) path along outer conductor 8 in the circumferential direction. The two supporting sections 43, 44 of carrier body 4, together with connecting sections 41, 42 and support regions 41*a*, 42*a*, form an (open) annular contour.

In the region of first and second connecting sections 41, 42, carrier body 4 extends radially through a respective first slot 81 of outer conductor 8. That is, support regions 41*a*, 42*a* of carrier body 4 are located substantially inside the space surrounded by outer conductor 8, so that, in particular, the active electrical device 5 placed on carrier body 4 is also disposed inside that interior space. However, in the region of its connecting sections 41, 42, carrier body 4 is configured to extend radially out of the interior space of outer conductor 8 (through a respective one of first slots 81).

Accordingly, supporting sections 43, 44 of carrier body 4, which extend from connecting sections 41, 42, extend outside of the space enclosed by outer conductor 8. In the exemplary embodiment, supporting sections 43, 44 each extend in an arcuate path along the outer wall of outer conductor 8 in the circumferential direction. Together, the two supporting sections 43, 44 embrace outer conductor 8 over an angle of about 180° in the circumferential direction.

Supporting sections 43, 44 of carrier body 4 each have a free end 43*a*, 44*a* pointing away from the respective connecting section 41 or 42 from which the respective supporting section 43 of carrier body 4 extends. Free ends 43*a*, 44*a* of supporting sections 43, 44 are disposed opposite one another and face each other, so as to form the described annular contour together with connecting sections 41, 42 and support regions 41*a*, 42*a*. In the exemplary embodiment, free ends 43*a*, 44*a* are (slightly) spaced apart. In another embodiment, they may also contact each other.

The stranded drain wires 21, 22 extending from electrical cable 1 are disposed with their respective free end portions 21*a*, 22*a* in second slots 82 of outer conductor 8, so that second slots 82 are partially closed by stranded drain wires 21, 22. Stranded drain wires 21, 22 may be fixed within the respective second slots 82 by a material-to-material bond, for example by soldering, brazing, or welding.

The space between outer conductor 8 and the connector components 31-34, 4, 5 and 71-74 disposed therein is partially filled with a potting body 85 (potting compound), for example in the form of an injection-molded part. In the present case, the potting body is disposed on the inner side of outer conductor 8 facing the interior of the connector and, together with outer conductor 8, encloses the aforementioned components 31-34, 4, 5 and 71-74 of the connector. Potting body 85 has channels 86 in which the free end portions 21*a*, 22*a* of stranded drain wires 21, 22 are received and guided.

In addition to the aforedescribed function as a holder for active electrical device 5, carrier body 4 may, as a (multi-) functional bracket, also perform a plurality of additional functions on the connector.

For example, in the present case, carrier body 4 serves (also) as a positioning means for positioning outer conductor 8 on the connector. Specifically, such positioning of outer conductor 8 relative to carrier body 4 is done by sliding outer conductor 8 with its first slots 81, which are open on the cable side (i.e., at the respective ends 81*a* facing electrical cable 1), over carrier body 4, more specifically over connecting sections 41, 42 of carrier body 4, until the closed ends 81*b* of the slots 81, which are opposite the open cable-side ends 81*a*, come into engagement with carrier body 4, as illustrated in FIG. 1B. That is, closed ends 81*b* of slots 81 serve as stops for the positioning of outer conductor 8 on carrier body 4 (along longitudinal cable direction L).

At the same time, outer conductor 8 is thus disposed in a form-fitting manner on carrier body 4 (via first slots 81). In addition, outer conductor 8 may also be connected by a material-to-material bond to carrier body 4, such as by welding.

At its open, cable-side end 81*a*, a respective first slot 81 of outer conductor 8 may be formed with an entry bevel (ramp), so as to prevent outer conductor 8 from being damaged while being slid onto carrier body 4.

In an embodiment of the present invention, carrier body 4 may have axially extending projections 46 which (partially) cover first slots 81 (compare FIG. 1B) when carrier body 4 and outer conductor 8 are aligned and positioned as intended relative to one another. Such projections 46 may also serve as guide means for guiding outer conductor 8 as it is slid onto carrier body 4. Furthermore, the projections may act as an EMC labyrinth; i.e., not only may they reduce the clear line of sight, but they may also counteract entry of electromagnetic waves into the space inside outer conductor 8.

In the exemplary embodiment, further functions of carrier body 4 include relieving the connector components 31-34, 4, 5, 71-74 located in the interior space of outer conductor 8 from tensile and compressive strains when forces/torques are acting on outer conductor 8, as well as relieving stranded drain wires 21, 22 from tensile and compressive strains, especially when torsional forces are acting (along the circumferential direction of outer conductor 8). This makes it possible to prevent shearing off of stranded drain wires 21, 22.

In addition, a keyed housing may be positioned and snapped onto carrier body 4. Moreover, a capacitor may be disposed between carrier body 4 and contact elements 31, 32; 71, 72 to provide for (capacitor-based) AC decoupling.

Figure 3A:
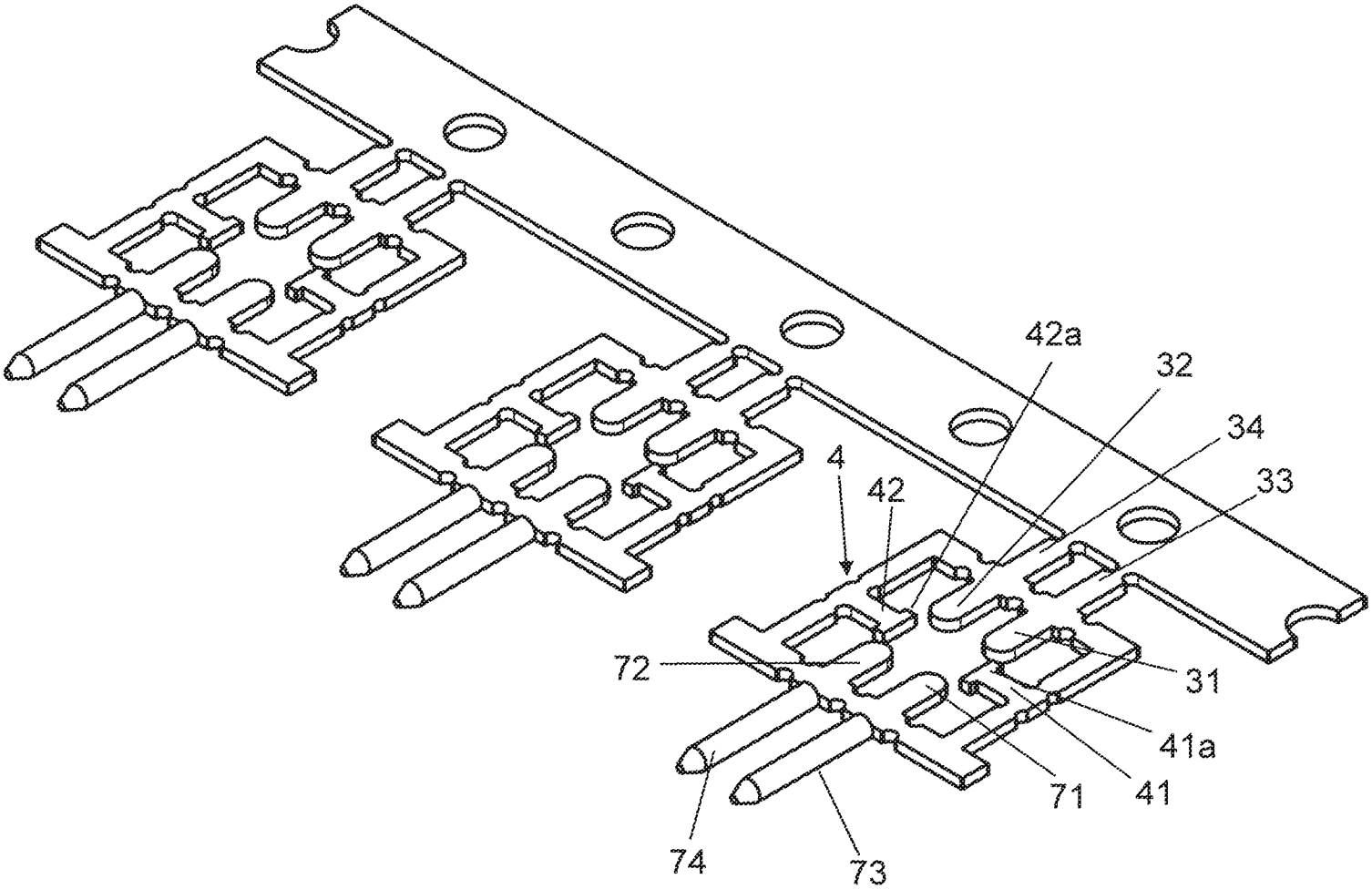
FIG. 3A shows an array of a plurality of stamped conductor patterns, form each of which components of the connector of FIG. 1A, in particular its contact elements, are formed by separating them.
Figure 4A:
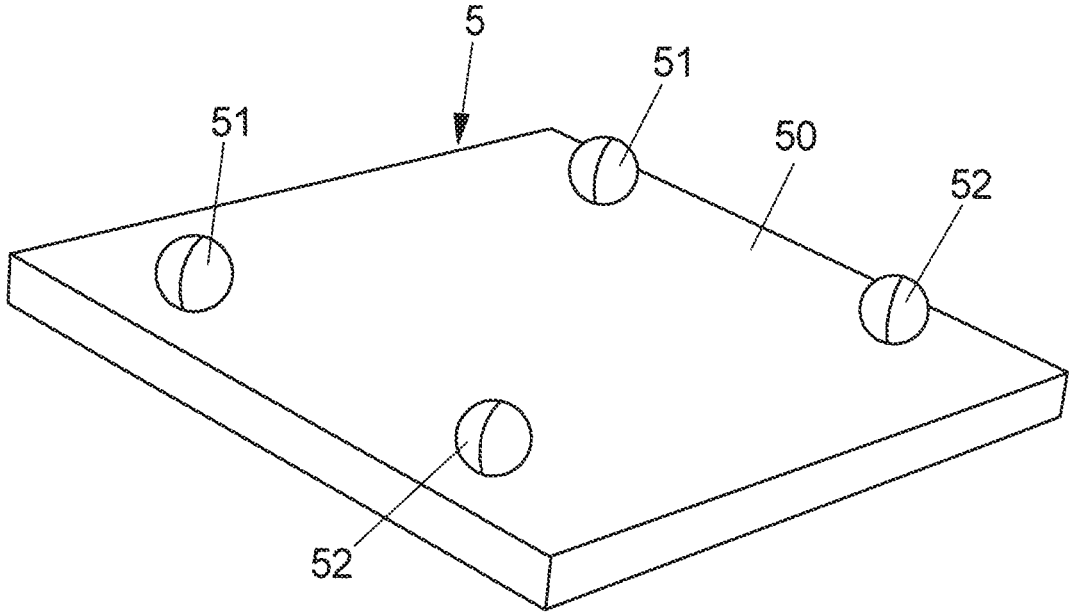
FIG. 4A shows a perspective view of the active electrical device of FIGS. 1A and 3B.

FIG. 3A shows stamped conductor patterns from which the connector components 31-34, 4 and 71-74 located within outer conductor 8 may be fabricated; i.e., cable-side electrical contact elements 31, 32 including the associated receptacles 33, 34, carrier body 4, as well as output-side electrical contact elements 71, 72 along with the associated connector elements 73, 74. As also shown in FIG. 3A, a plurality of such stamped conductor patterns may be provided as an endless strip.

In the condition shown in FIG. 3A, carrier body 4 has not yet been formed into the ring shape or stirrup shape, which it is intended to have according to FIGS. 1A and 1B. Rather, in FIG. 3A, the material region from which stirrup-shaped carrier body 4 will finally be formed is flat along its extent.

In order for the components 31-34, 4 and 71-74 incorporated in the stamped conductor pattern to be installed in the connector, outer conductor 8 may be slid over the laterally projecting wings of carrier body 4 (i.e., the later connecting and supporting sections 41, 43; 42, 44).

Once carrier body 4 and outer conductor 8 are positioned relative to one another as intended, which is when outer conductor 8 engages carrier body 4 with the closed ends 81*b* of its first slots 81, which act as stops, the final configuration of the components incorporated in the stamped conductor pattern is performed. To this end, firstly, carrier body 4 is bent into the condition shown in FIGS. 1A and 1B, in which its supporting sections 43, 44 extend along the outer circumference of outer conductor 8.

Furthermore, the components of the stamped conductor pattern are cut apart (e.g., through mounting openings provided in outer conductor 8), so that a total of five separate elements are obtained, namely two separate and spaced-apart cable-side contact elements 31, 32, each having a receptacle 33 or 34 integrally formed therewith, as well as two separate and spaced-apart output-side electrical contact elements 71, 72, each having a connector element 73 or 74 integrally formed therewith, the last-mentioned contact elements 71, 72 in addition being separated and (axially) spaced-apart from the first-mentioned contact elements 31, 32. Finally, there is a fifth (and possibly a sixth) element, which constitutes the (possibly multi-part, in particular two-part) carrier body 4 and which in the exemplary embodiment is separated and spaced-apart from all electrical contact elements 31, 32, 71, 72.

The cutting apart of the aforementioned components 30-34, 4, 71-74 may be accomplished, for example, by cutting through the webs that join those components in the stamped conductor pattern.

Figure 3B:
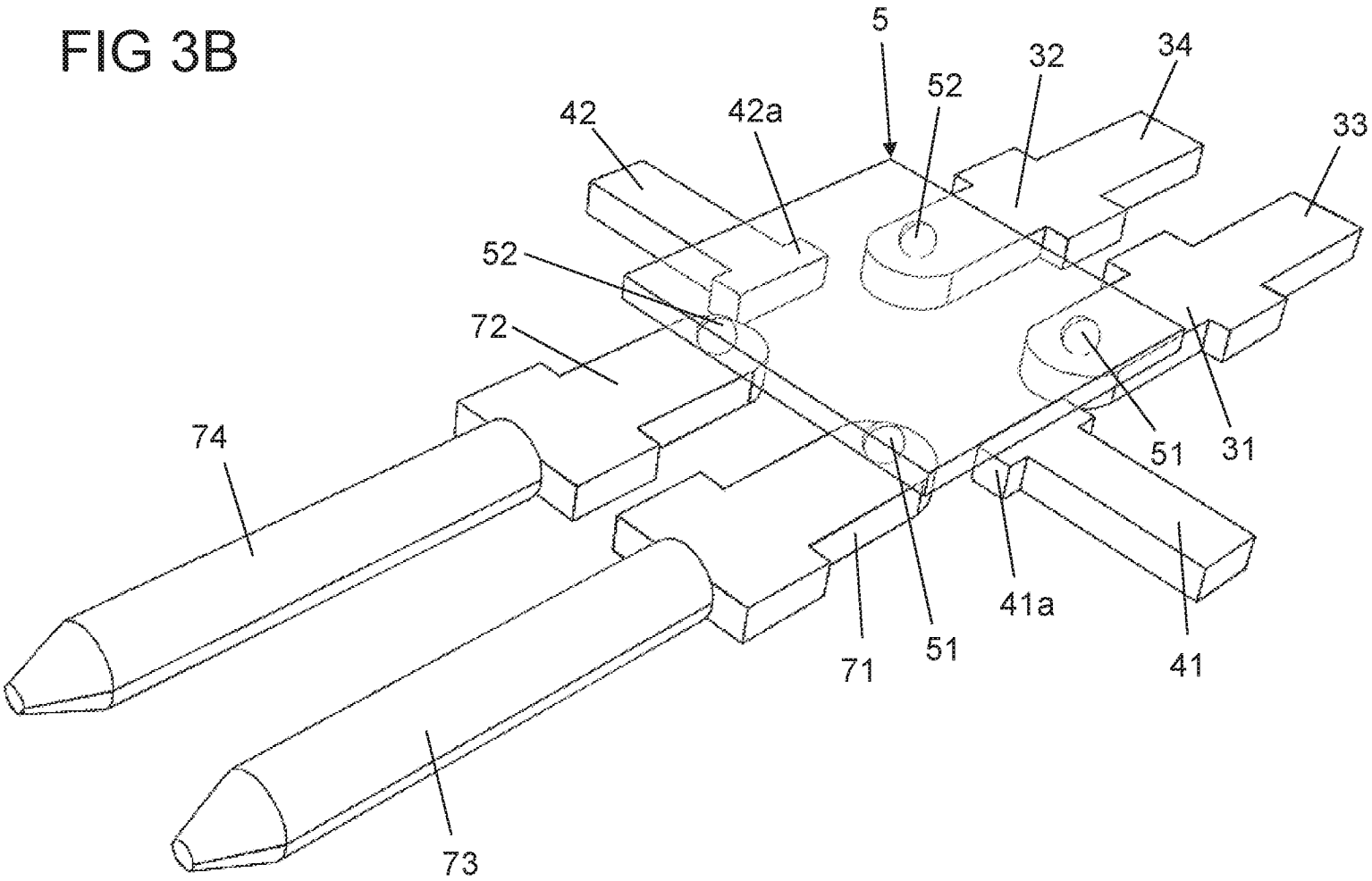
FIG. 3B shows a portion of the array of FIG. 3A after the components to be separated have been cut apart, illustrating in particular the configuration of the contact elements, and showing also an electrical device to be mounted thereon.

In FIG. 3B, the so cut-apart components 30-34, 4, 71-74 of the stamped conductor pattern are shown together with the active electrical device 5 to be disposed on carrier body 4, FIG. 3B being a modification of FIG. 3A in that no supporting sections 43, 44 to be bent are provided on the carrier body 4 shown in FIG. 3B. As can be seen from FIG. 3A and from the detail view of electrical device 5 in FIGS. 4A, 4B, the electrical device has electrical connecting elements 51, 52 in the form of (rigid) electrical connection points for making electrical contact with electrical contact elements 31, 32; 71, 72 of the connector, the electrical connecting elements 51, 52 slightly projecting from active electrical device 5 or, more specifically, from its underside (bottom 50) in this exemplary embodiment. Here, by way of example, the underside, takes the form of a printed circuit board, on which may be disposed the electrical and/or electronic components of the electrical device 5. The components of the active electrical device are electrically connectable and fixedly attachable to electrical contact elements 31, 32, 71, 72 via electrical connecting elements 51, 52.

Figure 4B:
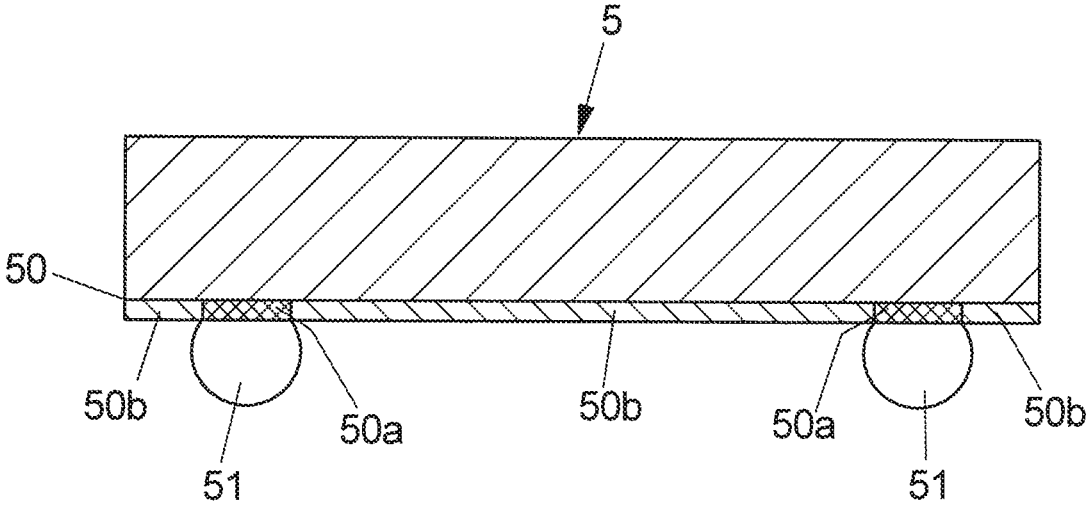
FIG. 4B shows a side view of the active electrical device.

In the exemplary embodiment of FIG. 4B, bottom 50 of active electrical device 5 has metallic portions 50*a* from which electrical connecting elements 51, 52 project and via which electrical connecting elements 51, 52 are in electrical contact with active electrical device 5. In the present case, exactly one electrical connecting element 51, 52 projects from each metallic portion 50*a* of bottom 50. Furthermore, the individual metal portions 50*a* of bottom 50 are separated and insulated from one another by insulating portions 50*b* of bottom 50.

Active electrical device 5 may be in the form of a bare die (i.e., an uncased electrical device). Moreover, it may be provided that, for example, an overmold or other protective covering not be produced until active electrical device 5 has been mounted on the connector-side contact elements, as described above.

The fixed attachment of electrical device 5 to electrical contact elements 31, 32; 71, 72 via the associated connecting elements 51, 52 may in particular be accomplished by a material-to-material bond, for example, by welding, soldering, brazing, or using an electrically conductive adhesive. Accordingly, the formation of the material-to-material bond may cause melting of the surface of electrical connecting elements 51, 52.

The inventive assembly may be used for different connector types, e.g., for USB connectors (such as USB 3.1 Type C), high-speed data (HSD) connectors, coax connectors with Fachkreis Automobil (FAKRA) interface (a German automotive standard), as well as mini-coax connectors.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. An electrical connector for a multi-wire electrical cable, the electrical connector comprising:

at least two cable-side electrical contact elements including associated terminals to each of which is to be connected a wire of the electrical cable;

at least two output-side electrical contact elements which are spaced apart from the cable-side electrical contact elements and from each of which projects an electrical connector element via which an electrical connection can be established to a mating connector; and an active electrical device disposed between the cable-side contact elements and the output-side contact elements, wherein the active electrical device is placed on the cable-side contact elements and on the output-side contact elements, such that the active electrical device is in electrical contact with each of the cable-side contact elements and the output-side contact elements, and such that each of the output-side contact elements is electrically connected to a respective one of the cable-side contact elements, and wherein the output-side contact elements are separated and axially spaced apart from the cable-side contact elements.

2. The electrical connector as recited in claim 1, wherein each of the cable-side contact elements is electrically connected via the active electrical device to the respective one of the output-side contact elements in such a manner that resulting electrical connections are arranged parallel to one another.

3. The electrical connector as recited in claim 1, wherein the active electrical device includes an amplifier, the active electrical device being configured to amplify data signals.

4. The electrical connector as recited in claim 1, wherein the cable-side contact elements include two separate and spaced-apart cable-side contact elements each having a respective one of the associated receptacles integrally formed therewith, wherein the output-side contact elements include two separate and spaced-apart output-side electrical contact elements each having a respective one of the electrical connector elements integrally formed therewith, and wherein two separate and spaced-apart cable-side contact elements and the two separate and spaced-apart output-side electrical contact elements are present as separate elements.

5. The electrical connector as recited in claim 1, wherein the cable-side contact elements and the output-side contact elements are parts of an integrally stamped conductor pattern which were separated by cutting.

6. The electrical connector as recited in claim 1, wherein a number of the cable-side electrical contact elements and a number of the output-side electrical contact elements on which the active electrical device is disposed is the same.

7. The electrical connector as recited in claim 1, wherein the active electrical device includes a processor.

8. The electrical connector as recited in claim 7, wherein the active electrical device is configured to process data signals.

9. The electrical connector as recited in claim 1, wherein electrical connecting elements project from a bottom of the active electrical device, the active electrical device resting via the electrical connecting elements on the respective contact elements.

10. The electrical connector as recited in claim 9, wherein the electrical connecting elements disposed on the bottom of the active electrical device are in the form of rigid electrical connection points via which the active electrical device rests on the contact elements in a fixed position relative thereto.

11. The electrical connector as recited in claim 9, wherein the electrical connecting elements are each connected by a material-to-material bond to the bottom of the active electrical device, the electrical connecting elements being configured as solder or weld balls.

12. The electrical connector as recited in claim 9, wherein the bottom of the active electrical device has metallic portions from which the electrical connecting elements project and via which the electrical connecting elements are in electrical contact with the active electrical device.

13. The electrical connector as recited in claim 12, wherein exactly one electrical connecting element projects from each metallic portion of the bottom of the active electrical device.

14. The electrical connector as recited in claim 12, wherein the metallic portions of the bottom of the active electrical device are separated and insulated from one another by insulating portions of the bottom of the active electrical device.

15. The electrical connector as recited in claim 1, further comprising a carrier body disposed between the cable-side contact elements and the output-side contact elements, the carrier body supporting the active electrical device without being in electrical contact therewith.

16. The electrical connector as recited in claim 15, wherein the cable-side contact elements and the output-side contact elements are parts of an integrally stamped conductor pattern which were separated by cutting, and wherein the carrier body forms a part of the integrally stamped conductor pattern which was separated by cutting from the cable-side and output-side contact elements.

* * * * *